US006543762B1

(12) United States Patent
Quadalti

(10) Patent No.: US 6,543,762 B1
(45) Date of Patent: Apr. 8, 2003

(54) MAGAZINE FOR FEEDING FLATTENED CONTAINERS TO A FILLING MACHINE

(75) Inventor: Cesare Quadalti, Faenza (IT)

(73) Assignee: Senzani Brevetti Officine di Faenza S.r.l., Faenza (IT)

( * ) Notice: Subject to any disclaimer, the term of this patent is extended or adjusted under 35 U.S.C. 154(b) by 0 days.

(21) Appl. No.: 09/976,269

(22) Filed: Oct. 15, 2001

(51) Int. Cl.[7] ..... G07F 11/01; B65H 1/30; B65H 1/26; B65H 1/14

(52) U.S. Cl. ..... 271/157; 271/158; 271/145; 221/11; 414/795.8

(58) Field of Search ..... 271/158, 157, 271/145; 221/11; 414/795.8

(56) References Cited

U.S. PATENT DOCUMENTS

| | | | | | |
|---|---|---|---|---|---|
| 1,807,864 | A | * | 6/1931 | Novick | 414/795.8 |
| 2,936,681 | A | * | 5/1960 | Earp | 271/158 |
| 3,587,916 | A | * | 6/1971 | Kellogg | 221/11 |
| 3,655,072 | A | * | 4/1972 | Bateman | 414/795.8 |
| 4,530,633 | A | * | 7/1985 | Lodi et al. | 414/414 |
| 4,538,511 | A | * | 9/1985 | Wise | 100/7 |
| 4,599,026 | A | * | 7/1986 | Feiber et al. | 414/126 |
| 4,618,054 | A | * | 10/1986 | Muller | 198/409 |
| 4,640,655 | A | * | 2/1987 | Jacobsen | 414/119 |
| 4,981,292 | A | * | 1/1991 | Cosgrove | 271/150 |
| 5,096,371 | A | * | 3/1992 | Mojden et al. | 414/795.8 |
| 5,161,938 | A | * | 11/1992 | Traegaardh | 414/795.8 |
| 5,213,321 | A | * | 5/1993 | Stobb | 271/149 |
| 5,398,931 | A | * | 3/1995 | Tohgoh | 271/126 |
| 5,785,489 | A | * | 7/1998 | Perego | 414/795.8 |
| 6,050,771 | A | * | 4/2000 | Dykstra | 414/795.8 |
| 6,247,694 | B1 | * | 6/2001 | Nonnemacher et al. | 271/146 |
| 2002/0131856 | A1 | * | 9/2002 | Schiesser et al. | 414/795.6 |

* cited by examiner

*Primary Examiner*—Donald P. Walsh
*Assistant Examiner*—Daniel Schlak
(74) *Attorney, Agent, or Firm*—Larson & Taylor PLC

(57) ABSTRACT

A composite magazine for feeding to a filling or packaging machine pre-formed and flattened containers includes a main magazine suitably inclined in which the containers are piled up. The main magazine includes a long upper back portion which can be opened and closed downwardly. Below the main magazine there is provided an ancillary magazine which initially is in a substantially horizontal loading position in order to be easily supplied with a pile of containers on a bottom plane which leaves uncovered lateral portions of the bottom of the pile. When the upper back portion is emptied, the upper back portion is opened and the ancillary magazine is raised to insert the pile of containers in the main magazine. The upper back portion then closes to retain the pile, while the ancillary magazine returns in the low loading.

13 Claims, 4 Drawing Sheets

MAGAZINE FOR FEEDING FLATTENED CONTAINERS TO A FILLING MACHINE

FIELD OF THE INVENTION

The invention relates to filling or packaging machines used to place solid or liquid goods inside pre-formed cardboard cases or containers, hereinafter called with the generic term containers. The containers arrive from the paper manufacturer with a tubular and flattened shape, so that they can be fed in great quantity as piles in vertical magazines. Frequently the containers are piled with an inclination of about 45–60° with respect to the horizontal, in order for the piles to be longer and more ample and positioned lower and so that they can be more easily fed by an operator with respect to the vertical magazines.

BACKGROUND OF THE INVENTION

The present practice is to use vertical magazines having a great length so that they can contain a great quantity of containers, but said lengthy magazines have their terminal or end portion at a considerable distance from the ground. Consequently, such magazines are not easily reached by the operator who must cyclically supply them. It will also be appreciated that often the magazines are arranged in pairs side by side, in order to increase the working ability of the packaging machine.

The technical problem that actually is found in the packaging machines with manual re-filling of the magazines is therefore of double aspect and consists, on one hand, in the discomfort for the operator to execute the re-filling operation and, on the other hand, in the difficulty for only one operator to supply the magazines of a plurality of packaging machines placed in the same working environment and simultaneously operating.

SUMMARY OF THE INVENTION

The invention resolves these problems with the following solution. Under the inclined and traditional vertical magazine, called the main magazine, which can be structured with a great length and consequently with a great working ability, there is mounted an ancillary magazine which is initially in a loading position almost horizontal so as to be easily re-filled with containers by the operator. The ancillary magazine can thus support a pile or series of containers between longitudinal ends and by a portion of the lower or bottom plane or side, so that with the support of this bottom plane the free lateral portions of the pile are free both laterally and at the top. The main magazine is provided with an upper back portion having a length proportional to the length of the ancillary magazine, which upon suitable control may open and close itself downwardly. When the upper portion of the main magazine is emptied of the containers, the upper back portion is opened and the upward movement of the ancillary magazine is effected to insert its pile of containers in the main magazine. Subsequently, the upper back portion is closed again to retain the pile of containers therein and to allow to the ancillary magazine to return empty in the lower loading position for repeating a new working cycle.

The advantages arising from this solution include an easy cyclic feeding of the containers to the ancillary magazine which in the phase of loading is at man-height and in an almost horizontal position. Thus, the feeding of the containers to the ancillary magazine can be effected during the long time interval which passes from the filling of the main magazine until the substantial emptying of said main magazine, so that an operator has a lot of time to feed several such ancillary magazines simultaneously operating several packaging machines. The working ability of the composite magazine according to the invention is now derived from the sum of the capability of the main magazine and the capability of the ancillary magazine. It will also be appreciated that the presence of the ancillary magazine does not substantially modify the overall plan dimensions of the main magazine, because the ancillary magazine can be substantially placed under the main magazine.

BRIEF DESCRIPTION OF THE DRAWINGS

Further features of the invention, and the advantages deriving therefrom, will be evident from the following description of a preferred embodiment of the invention made with reference to the figures of the attached sheets of drawings, in which.

DETAILED DESCRIPTION OF THE INVENTION

The drawings generally show an example of the present invention with two main magazines arranged side by side, and with the associated ancillary magazines in the two different working positions. It is to be understood that the invention referred to below is intended as well for a composite magazine of a more simple type, that is a magazine formed by only a main magazine with a single associated ancillary magazine.

Figure 5:
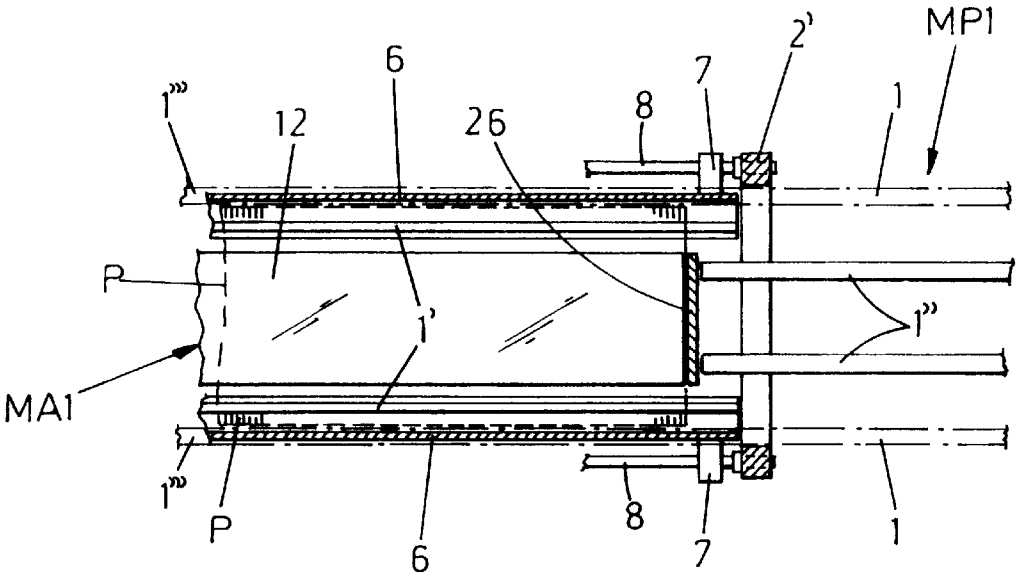
FIG. 5 is a schematic and top view of the ancillary magazine inserted into the main magazine, taken along the section line V—V of FIG. 4.
Figure 4:
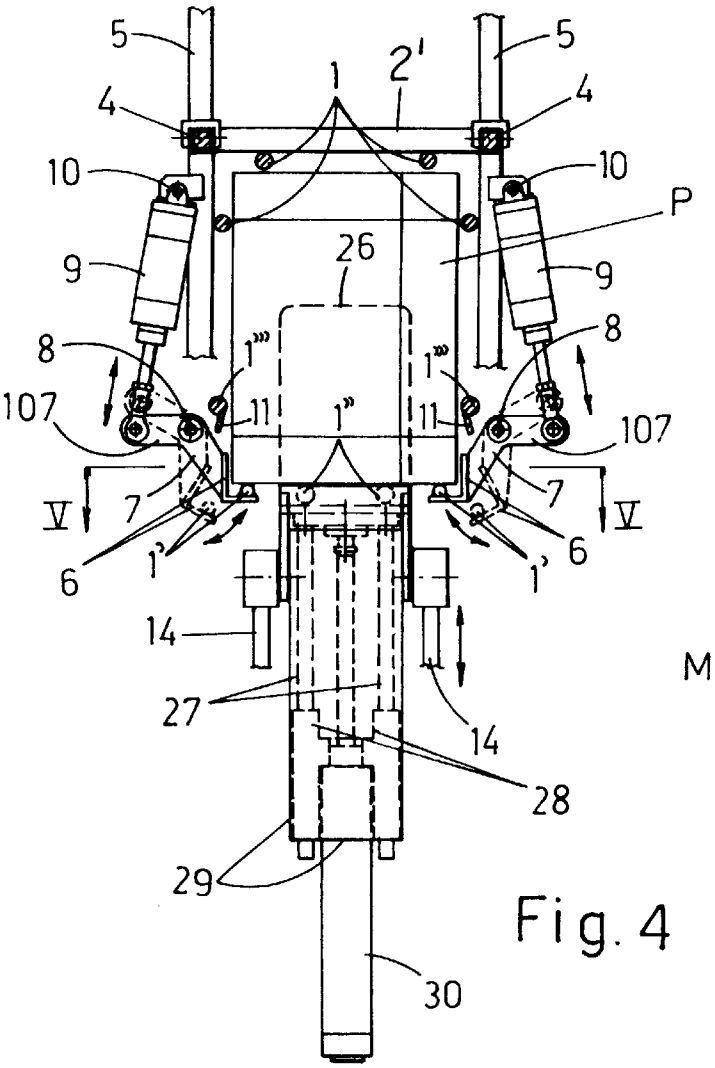
FIG. 4 shows details of the main magazine in the phase of grasping of the containers from the ancillary magazine located in the raised position, taken along the section line IV—IV of FIG. 1.

In the figures, with references MP1 and MP2 there are respectively indicated the two main magazines. These main magazines are inclined as shown, and differ from the magazines of the known type by having a greater length and therefore for having an upper end at a higher distance from the ground. Each main magazine is a tubular structure formed by longitudinal guides 1, for example steel rods, which support and guide upwardly, downwardly and laterally the pile P of containers. The guides 1 are, in their turn supported at the ends thereof by transversal structures or supports 2, 2' of annular type (FIGS. 4 and 5). In particular, the lower support 2' is fixed to the frame 3 of the packaging machine and is connected to the upper structure 2 by beams 4 fixed (in their turn) to the frame 3 by tie rods 5.

According to the invention, the long or upper back portion of each main magazine which is comprised between the transversal structures 2, 2' has at least the lower guides 1' which, upon command, can be opened like a door—that is in such a manner that the lower guides 1' can pass from the position shown in FIG. 4 with a continuous line to the one shown with a dotted line and vice versa, in order to open and close vertically the associated upper back portion of the main magazine. From the FIGS. 1 and 4 it is pointed out that the lower guides 1' are welded for example onto respective "L" shaped section bars 6, which bars 6 carry fixed at their ends the levers 7 which are in their turn fixed upon a shaft 8 parallel to the section bar 6, and which shafts 8 are supported rotatably at the ends by means of supports 2, 2'.

At least one of the levers 7 extends beyond the fulcrum shaft 8 with a shaft 107 articulated to the rod of a jack 9 which is articulated at joint 10 to the near support 2. All the jacks of the apparatus referred to can be of the fluid pressure type or of the electromechanical screw-nut screw type. The jacks 9, if they are of the fluid pressure type, are preferably of the simple effect type and normally extended, to maintain the guides 1 normally in a closing position of the main magazine.

From FIG. 5 it can be noted that the lower movable guides 1' terminate beyond the initial ends of lower fixed guides 1" in order to ensure continuity of support to the containers during the forwards displacement from 1' to 1". The initial ends of the guides 1" are shaped so as to favor the reception of the containers, for example with a suitable downward bending.

At least the lateral lower guides 1" of each main magazine can be provided with longitudinal and continuous fins 11. Fins 11 are downwardly oriented and outwardly diverging, in order to form a reception zone which facilitates the inlet of the pile of containers cyclically fed into the main magazine, as mentioned further on.

Figure 1:
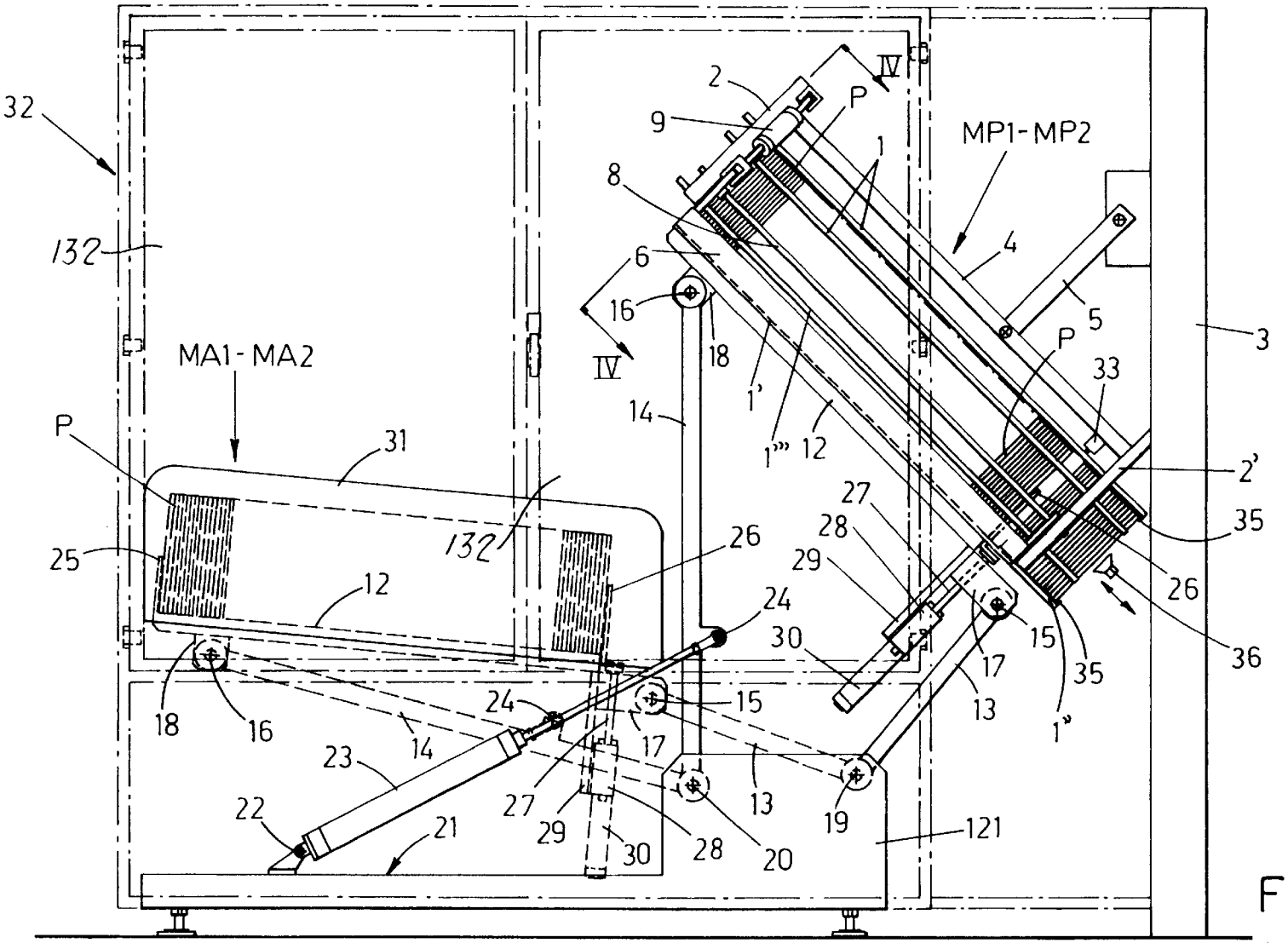
FIG. 1 is a side elevation view of the composite magazine, with the ancillary magazine shown in the two working positions.

For and under each main magazine, there is provided a respective ancillary magazine MA1 and MA2 which comprises a flat surface plane 12 having a width for example substantially equal to the distance which passes between the lower fixed guides 1" of the main magazine (FIG. 5) and having a length a little less than the length of the movable guides 1'. Plane 12 is connected to a motion means of any suitable kind which causes plane 12 to pass from a low and substantially horizontal loading position, as indicated in FIG. 1 with dotted line, to a raised unloading position in which said plane 12 is inserted in the upper back portion of the associated main magazine. In the raised position, the plane 12 of the ancillary magazine is located immediately upwardly from, co-planar with, and longitudinally aligned with the inferior and fixed guides 1'.

According to a preferred embodiment, the motion means 20 of the plane 12 are constituted by an articulate quadrilateral which comprises a lever 13 and a pair of levers 14 respectively articulated in joints 15 and 16 to end appendices 17 and 18 of the plane 12, and respectively articulated in joints 19 and 20 to a raised base portion 121 of a base 21. Base 21 bears onto the ground and has articulated thereto in joint 22 the body of a jack 23, in its turn articulated by the rod thereof at joint 24 to the intermediate portion of the pair of levers 14. It is to be understood that the movements of the plane 12 can be effected with different means than the articulated quadrilateral, for example with direct articulation of said plane to the main magazine or to the frame 3 of the packaging machine, although the utilization of the articulated quadrilateral system is preferred because it eliminates the limitations that can derive from the overall dimensions of the frame of the packaging machine and because it allows the plan 12, when it is in the lower loading position, to be advantageously out from the plan overall dimensions of the main magazine so that the main magazine does not hinder the operator which provides for the cyclic feeding of the containers.

The plane 12 carries, at a right angle, upon the end farthest to the articulation system, a fixed and upwardly oriented head board 25, while on the other end it carries a head board 26, parallel to the previous one but which in a different manner can be withdrawn upon command below the plane 12. For this purpose the board 26 is mounted upon a slide 27 (FIGS. 1 and 3) slidable upon a guide 28, fixed to an appendix 29 under the plane 12 and upon which is fixed the body of an actuator 30 of said slide 27, for example the body of a jack.

When the plane 12 is in the low loading position, plane 12 is preferably arranged with a slight inclination with respect to the horizontal position and the board 26 is in the high position, so that the operator can arrange against board 26 the packages or containers P put on their edge upon the plane 12, until containers P constitute a pile or series that results and is sufficiently compressed between the head boards 26 and 25.

Laterally to the plane 12 there is a vertical and parallel plane 31. Plane 31 is fixed, for example, to the frame 21, and the containers P bear against plane 31 as the containers are piled in the ancillary magazine. The containers P thus laterally project with the same length from the plane 12 and with their sides in alignment.

Figure 2:
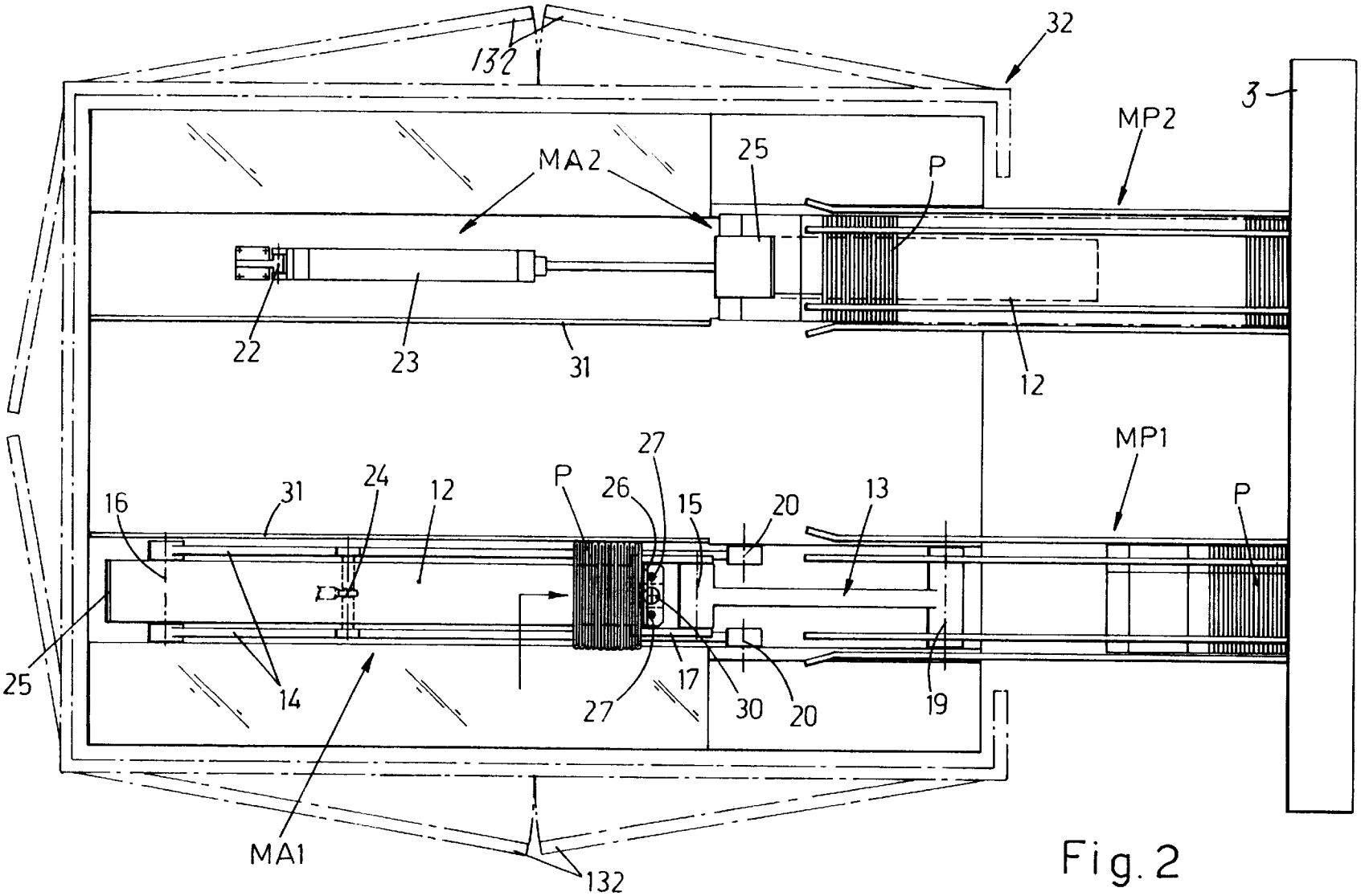
FIGS. 2 and 3 are views respectively in plan from the top and in frontal elevation of the composite magazine with the ancillary magazine shown in the two working positions.
Figure 3:
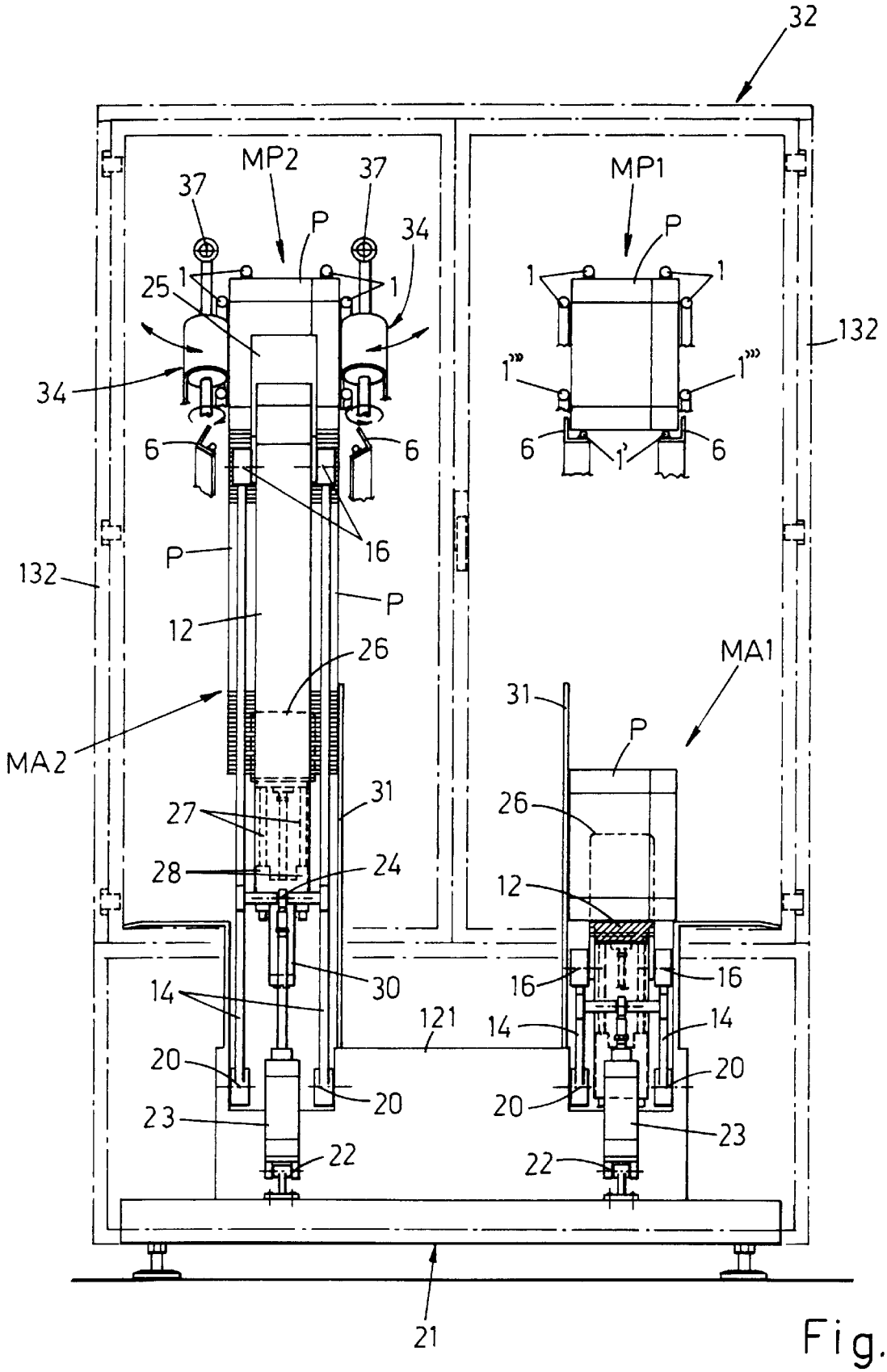

From FIGS. 1, 2 and 3 it can be seen that the ancillary magazines are preferably placed inside a box 32 which also contains the main magazines and which is laterally provided with doors 132 controlled by microswitches which activate the working of the apparatus only when the doors 132 are closed. Once the ancillary magazine is filled in the low loading position and once the doors 132 are closed, and when in the main magazine the containers P come to occupy only the lower fixed guides 1", a control device such as sensor 33 (FIG. 1) detects this condition and actuates the following steps. The inferior and mobile guides 1' of the main magazine are opened as shown with dotted line in FIG. 4 and the filled plane 12 of the ancillary magazine is raised as shown in FIG. 4 and as shown with the continuous line in FIG. 1.

Next, the guides 1' return in the active position indicated with continuous line in FIG. 4, in order to support the new pile or series of containers inserted in the main magazine by the filled ancillary magazine. Then the movable board 26 is moved downwardly to release the pile of containers P, and the empty plane 12 is carried back in the low position for the repetition of a new working cycle.

In order to avoid dead times during the working phase, it can be provided that after the ancillary magazine is filled with containers and after the closure of the doors 132 of the box 32, the filled ancillary magazine raises part way up and conveniently gets near to the main magazine, in order to reduce the times of the next supply travel of the filled ancillary magazine.

If the main magazine has a considerable length, in the portion of the main magazine which is defined by the movable guides 1', there can be laterally provided motorized conveyers 34 (FIG. 3). Conveyors 34 operate with friction on the sides of the pile of containers P, in order to feed progressively the containers P upon the fixed guides 1". In this manner, conveyors 34 avoid the exertion of any excessive thrust on the bottom or front-most container P that cyclically must be extracted from the head retainers 35 of the main magazine by means of the suction cups 36 which are provided for the cyclical insertion of the front-most container inside the packaging machine. The conveyers 34 are, for example, provided to oscillate upon fulcrums 37 in order to be spaced during the phase of insertion of the pile of containers in the main magazine, so that they do not interfere with this procedure. The actuation means of the conveyers 34 are not shown in the drawings, because they are conceivable and easily realizable by persons skilled in the art.

Several variations and modifications to the above invention can be appreciated. For example, the utilization of different means from those described for the operation of the movable guides 1' are possible, so that such means could derive their motion from the movement of the plane 12, for example by means of suitable cams. Other variants can be appreciated where in the portion of the main magazine cyclically fed by containers, also the lateral guides are movable in addition to the bottom guides 1', to avoid undesired interferences of the pile of containers with the lateral guides. For this purpose, the lateral guides could be, for example, combined with the oscillating structure which provides for the movements of the conveyers 34.

What is claimed is:

1. A system for feeding pre-formed flattened containers to a filling machine comprising:

a main magazine which is inclined with respect to horizontal from an upper back end to a lower front end and in which the containers are cyclically piled up in a stack to provide a front-most container, said main magazine having an extensive length from front to back and including, a retainer for the front-most container at the front end, an extraction means at the front end for extracting cyclically the front-most container and for feeding the front-most container to the filling machine, an upper back portion having a bottom which supports any associated part of the stack of containers, and an opening means for opening the bottom of the upper back portion for a reception of a series of containers upwardly therethrough and for closing the bottom of the upper back portion to retain the series of containers received upwardly therethrough to form an added part of the stack of containers in said main magazine;

an ancillary magazine provided below said main magazine in a horizontal loading position, said ancillary magazine including a bottom plane which supports the series of the containers thereon from a back end to a front end while leaving both lateral-bottom sides of the series of containers free from restraint, a back end support for the containers provided at the back end of the bottom plane and a front end support provided at the front end of the bottom plane, between which said back end support and front end support the series of containers are located, and a raising means for moving said ancillary magazine between the horizontal loading position and an unloading position located through the opened bottom of the upper back portion; and a control device which cyclically operates, when said upper back portion of said main magazine is emptied of containers, (a) to actuate said opening means to open the bottom of said upper back portion and to actuate said raising means to move said ancillary magazine to the unloading position, and (b) to then actuate said opening means to close the bottom of said upper back portion to vertically support the lateral-bottom sides of the pile of the containers of said ancillary magazine and to actuate said raising means to move said ancillary magazine back to the horizontal loading position leaving the series of containers in the upper back portion of the main magazine.

2. A system for feeding pre-formed flattened containers as claimed in claim 1:

wherein said bottom of said upper back portion includes longitudinal back lower guides;

wherein said opening means for said bottom includes respective section bars upon which respective said back lower guides are fixed, respective fixed levers to which respective ends of said section bars are attached, respective fulcrum shafts to which respective said fixed levers are attached and which are parallel to said section bars, respective annular structures which support respective ends of said fulcrum shafts, an extension arm attached to and extending laterally beyond one of said fulcrum shafts, and a reciprocal actuator to which said extension arm is attached such that when said actuator moves said extension arm is a reciprocal motion, said back lower guides of said bottom are moved to open and close said bottom; and wherein said main magazine further includes upper lateral guides longitudinally disposed above said back lower guides and extending between said annular structures for guiding of the stack of containers along said main magazine.

3. A system for feeding pre-formed flattened containers as claimed in claim 2, wherein said reciprocal actuator is one of a fluid pressure jack or a screw and nut-screw device.

4. A system for feeding pre-formed flattened containers as claimed in claim 2, wherein said main magazine further includes front lower guides which (a) are coplanar with said back lower guides when said back lower guides close the bottom, and (b) terminate rearwardly of said front lower guides, said front lower guides providing a continuity of support as containers move from said back lower guides to said front lower guides.

5. A system for feeding pre-formed flattened containers as claimed in claim 4, wherein said upper back portion of said main magazine further includes:

respective back lateral guides extending parallel to said bottom and located above said back lower guides such that the containers in said bottom are laterally guided by said back lateral guides, and respective fins provided on said back lateral guides and oriented downwardly and outwardly to act as guiding inlets for the containers as said ancillary magazine is raised through said bottom and between said back lower guides.

6. A system for feeding pre-formed flattened containers as claimed in claim 5:

wherein said upper lateral guides include back portions;

wherein said section bars include respective extensions;

wherein said back portions of said upper lateral guides and said back lateral guides are connected to respective said extensions for movement with said back lower guides to a laterally open position at which said ancillary magazine is received therebetween.

7. A system for feeding pre-formed flattened containers as claimed in claim 1, further including first and second motorized conveyors respectively located along each lateral side of said upper back portion of said main magazine, said conveyors being movable between (a) an engaged position where said conveyors engage opposite lateral sides of the part of the stack of containers located in said upper back portion in order to control a downward movement of the part of the stack towards the lower front end so as to avoid excessive pressure on the front-most container by the stack, and (b) an unengaged position where said ancillary magazine is freely moved to the raised position in said upper back portion.

8. A system for feeding pre-formed flattened containers as claimed in claim 7, wherein each said conveyor is mounted on a respective fulcrum-oscillating structure in order to move between the engaged and unengaged positions, said fulcrum-oscillating structures being parallel to said back lower guides.

9. A system for feeding pre-formed flattened containers as claimed in claim 1, wherein said raising means includes a support structure upon which said ancillary magazine is located, said support structure being oscillatory about an axis which is horizontal and perpendicular to a vertical plane including longitudinal axes of said main magazine and said ancillary magazine.

10. A system for feeding pre-formed flattened containers as claimed in claim 1:

wherein said bottom plane of said ancillary magazine is inclined at a slight angle to horizontal to facilitate piling of containers thereon; and wherein said raising means includes a base, a pair of levers, each said lever being rotatably connected at one end to said base and at the other end to said ancillary magazine such that an articulated quadrilateral structure is formed, and an oscillation actuator connected to said quadrilateral structure for moving said quadrilateral structure to move said ancillary magazine between the loading position and the unloading position.

11. A system for feeding pre-formed flattened containers as claimed in claim 1:

wherein said ancillary magazine further includes a slide to which said front end support is mounted, a perpendicular guide in which said slide is located for movement therealong, said perpendicular guide being located beneath said bottom plane, an actuator which is controlled by said control device and which is attached to said slide to move said slide between (a) an interfering position where said front end support engages a front-most container of the series of containers on said bottom plane and (b) a non-interfering position where said front end support is moved downwards and out of engagement with the front-most container of the series after said ancillary magazine is raised to the unloading position.

12. A system for feeding preformed flattened containers as claimed in claim 1:

wherein said ancillary magazine includes a first lateral side from which containers are loaded onto said bottom plane and a second lateral side opposite to said first lateral side; and further including a vertical and fixed wall located parallel and adjacent to said second lateral wall when said ancillary magazine is in the horizontal loading position, said fixed wall serving as an alignment fixture for the containers loaded on said bottom plane.

13. A system for feeding pre-formed flattened containers as claimed in claim 1, further including a box in which said main magazine, said ancillary magazine, said raising means and said control device are located, said box including lateral doors whose closed position is sensed by said control device.

* * * * *